US005394928A

United States Patent [19]

Hammond et al.

[11] Patent Number: 5,394,928

[45] Date of Patent: Mar. 7, 1995

[54] CAST COMPOSITE MATERIAL WITH HIGH-SILICON ALUMINUM MATRIX ALLOY AND ITS APPLICATIONS

[75] Inventors: Donald E. Hammond, San Diego; Michael D. Skibo, Leucadia, both of Calif.

[73] Assignee: Alcan International Ltd., Montreal, Canada

[21] Appl. No.: 940,265

[22] Filed: Sep. 2, 1992

Related U.S. Application Data

[63] Continuation of Ser. No. 784,615, Oct. 29, 1991, Pat. No. 5,186,234, which is a continuation of Ser. No. 572,218, Aug. 16, 1990, abandoned.

[51] Int. Cl.[6] ..... B22D 19/14

[52] U.S. Cl. ..... 164/97; 164/91

[58] Field of Search ..... 164/97, 98, 100, 101, 164/102, 103, 105, 91

[56] References Cited

U.S. PATENT DOCUMENTS

| | | | |
|---|---|---|---|
| 4,232,091 | 11/1980 | Grimshaw | 164/91 |
| 4,687,043 | 8/1987 | Weiss et al. | 164/100 |
| 4,696,866 | 9/1987 | Tanaka et al. | 164/98 |
| 4,739,817 | 4/1988 | Hamajima et al. | 420/590 |
| 4,759,995 | 7/1988 | Skibo et al. | 428/614 |
| 4,786,467 | 11/1988 | Skibo et al. | 428/614 |
| 4,871,008 | 10/1989 | Dwivedi et al. | 164/97 |
| 4,899,800 | 2/1990 | Gallerneault et al. | 164/97 |
| 5,005,531 | 4/1991 | Dwivedi | 164/97 |
| 5,076,340 | 12/1991 | Bruski | 164/97 |
| 5,097,887 | 3/1992 | Schmid | 164/97 |
| 5,186,234 | 2/1993 | Hammond | 164/97 |

FOREIGN PATENT DOCUMENTS

| | | |
|---|---|---|
| 0375588A | 6/1990 | European Pat. Off. . |
| 60-138043 | 7/1985 | Japan . |
| 64-11930 | 1/1989 | Japan . |
| 1-246341 | 10/1989 | Japan . |
| 1-254366 | 10/1989 | Japan . |

OTHER PUBLICATIONS

M. K. Surappa and P. K. Rohatgi, "Production of aluminum-graphite particle composites using copper-coated graphite particles," *Metals Technology*, pp. 358-361 (1978).

M. K. Surappa and P. K. Rohatgi, "Preparation and properties of cast aluminium-ceramic particle composites," *J. Materials Sci.*, vol. 16, pp. 983-993 (1981).

A. Banerji and P. K. Rohatgi, "Cast aluminium alloy containing dispersions of TiO2 and ZrO2 particles," *J. Materials Sci.*, vol. 17, pp. 335-342 (1982).

K. Gopakumar, T. P. Murali, and P. K. Rohatgi, "Metal—shell char particulate composites using copper—coated particles," *J. Materials Sci.*, vol. 17, pp. 1041-1048 (1982).

Iseki et al., "Interfacial reactions between SiC and aluminum during joining", *J. Materials Sci.*, vol. 19, pp. 1692-1698 (1984).

V. Laurent et al., "Wettability of SiC by aluminium amd Al-Si alloys," 1987 Preprint of Chapman and Hall, Ltd.

Warren et al., "Silicon carbide fibers and their potential for use in composite materials," 1984 Preprint of Butterworth & Co.

Metals Handbook Desk Edition, ASM, Dec. 1985.

*Primary Examiner*—P. Austin Bradley
*Assistant Examiner*—Erik R. Puknys
*Attorney, Agent, or Firm*—Gregory Garmong

[57] ABSTRACT

A cast composite material is formed from about 5 to about 35 volume percent of particulate reinforcement, preferably silicon carbide particles, embedded in an aluminum alloy matrix having from about 8.5 to about 12.6, most preferably about 9.5 to about 11.0, weight percent silicon. The cast composite material is particularly well suited for use as a foundry alloy for remelting purposes. Other alloying elements may be added without interfering with the beneficial effects of the silicon.

12 Claims, 3 Drawing Sheets

CAST COMPOSITE MATERIAL WITH HIGH-SILICON ALUMINUM MATRIX ALLOY AND ITS APPLICATIONS

This application is a continuation of application Ser. No. 07/784,615, filed Oct. 29, 1991, now U.S. Pat. No. 5,186,234, for which priority is claimed, which in turn is a continuation of abandoned application Ser. No. 07/572,218, filed Aug. 16, 1990, for which priority is claimed.

BACKGROUND OF THE INVENTION

This invention relates to cast metal-matrix composite materials, and, more particularly, to such composites having a matrix alloy tailored to avoid the formation of harmful intermetallic phases.

Cast composite materials are formed by melting a matrix alloy in a reactor and then adding solid particulate matter. The mixture is vigorously mixed to encourage wetting of the matrix alloy to the particles, which remain solid during the mixing, and after a suitable mixing time the mixture is cast into molds or forms. The molten metallic matrix solidifies as it cools, resulting in a cast solid composite material. The mixing is conducted while minimizing the introduction of gas into the mixture.

The cast composite materials have fully wetted particles, few voids, and a generally uniformly mixed structure. Such cast composite materials are much less expensive to prepare than other types of metal-matrix composite materials such as those produced by powder metallurgical technology. Composite materials produced by this approach, as described in U.S. Pat. Nos. 4,759,995 and 4,786,467, have enjoyed commercial success in only a few years after their first introduction.

One potential application of cast composite materials is in foundry remelt alloys. The composite materials are prepared by a supplier and cast into ingots at the supplier's plant. The cast ingots are transported to a commercial foundry, where they are remelted and cast to the final shape required by the customer. This foundry remelt approach is commonplace throughout industry for the processing of conventional aluminum alloys, and the introduction of aluminum-based cast composite materials into many applications is practical only where they can conform to this approach.

Experience has shown that, with the proper mixing technique, a wide variety of cast composite materials can be mixed by the suppliers. In the mixing step, the maximum temperature to which the molten composite may be heated is normally limited to avoid the production of unwanted reaction products between the matrix alloying elements and the reinforcement particles. Some reaction products can reduce the mechanical properties of the composite material and cause porosity in the composite material, and are therefore to be avoided.

However, many of these cast composite materials are not compatible with commercial foundry remelt practices. Cast composite materials used in remelt applications must permit high remelt temperatures, typically greater than those used in the composite mixing operation, and long remelt holding times. The casting of metallic composite materials into complex shapes requires that the molten material be superheated above its melting point and be highly fluid so that it can flow into cold mold cavities for a considerable distance before the superheat is removed and the metal freezes. The greater is the remelt temperature permitted for the material and the fluidity of the material, the greater is the distance the molten composite material may flow into mold cavities before it solidifies, and the more intricate the products that can be cast.

Additionally, present foundry techniques usually call for the melting of large masses of the casting alloy to reach a stable temperature distribution, and casting articles from the large melted mass. The remelted material may remain at elevated temperature for extended periods of time, such as up to 24 hours, before casting. During this holding period, the castability of the composite material may degrade, so that a composite material may be much less castable after such a holding period then if cast immediately upon remelting. It is important that the composite material be castable by such commercial practices that have been long established, to accelerate the acceptance of the composite material by foundrymen.

In one specific example, aluminum-7 weight percent silicon alloys have been used in industry for years as remelt alloys, because the alloy has good fluidity and acceptable mechanical properties after casting. A satisfactory composite material of, for example, 15 volume percent of silicon carbide particles in an aluminum-7 weight percent silicon alloy may be prepared and cast by the supplier with a maximum temperature of 1265° F. in the mixing process. Ingots of this alloy are furnished to a foundry remelter, who remelts the ingots and holds the molten composite at a conventional remelt temperature of about 1450° F. for 8 hours before casting. The molten composite material casts very poorly, has low fluidity, and results in unacceptable product. The composite material is therefore rejected for the particular application, even though it might otherwise provide important benefits to the final product.

There therefore exists a need for an improved approach to the preparation of cast composite materials, Particularly those for use in foundry remelt applications. The present invention fulfills this need, and further provides related advantages.

SUMMARY OF THE INVENTION

The present invention provides a cast composite material having a metallic alloy matrix component whose composition is carefully selected to avoid the formation of unwanted and deleterious phases during preparation, remelt, and final casting. The amount of one alleying ingredient is carefully controlled to prevent degradation of properties during remelting, formation of unwanted phases, and good castability. Other conventional alloying ingredients can be varied as necessary to attain other desirable properties of the final product. The particulate need not be altered or specially selected in order to attain good composite remelt properties.

In accordance with the invention, a composite material comprises a mixture of from about 5 to about 35 volume percent of nonmetallic reinforcing particles and from about 95 to about 65 volume percent of a matrix alloy, the matrix alloy being an aluminum-based alloy containing from about 8.5 to about 12.5 weight percent silicon. Other conventional aluminum alleying elements can be added to the matrix alloy as needed, and do not interfere with the beneficial effects of the silicon. Such other alleying elements include, for example, copper, nickel, magnesium, iron, and manganese.

In accordance with a processing aspect of the invention, a method for preparing a cast composite material comprises the steps of preparing a molten mixture of from about 5 to about 35 volume percent of free-flowing nonmetallic reinforcing particles and from about 95 to about 65 volume percent of a matrix alloy, the matrix alloy being an aluminum-based alloy containing from about 8.5 to about 12.6 weight percent silicon; mixing the molten mixture to wet the matrix alloy to the particles and to distribute the particles throughout the volume of the melt, the mixing to occur while minimizing the introduction of gas into and retention of gas within the molten mixture; and casting the molten mixture.

The composite material of the invention is particularly useful in remelt applications. It can be remelted to a conventional foundry remelt practice temperature of greater than 1300° F., and typically 1450° F. or more, and held for 24 hours, and then cast with good results. In a preferred embodiment having from about 9.5 to about 11.0 weight percent silicon, the same good casting results are attained with even further improved microstructures in the cast final product.

The present invention provides an important advance in the art of cast composite materials, by providing a foundry remelt alloy that can be readily cast by conventional remelt practices. Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
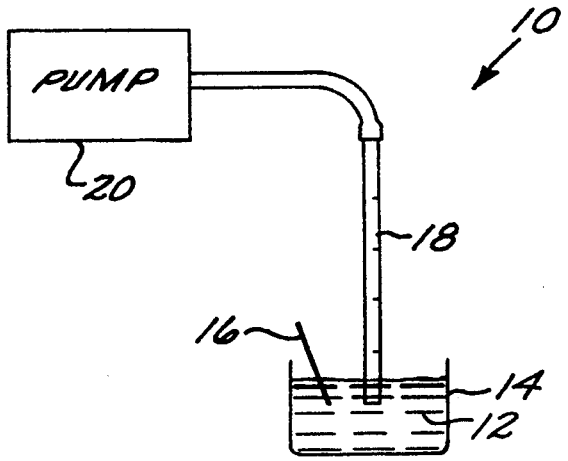
FIG. 1 is a schematic illustration of a fluidity testing apparatus.

In accordance with a preferred embodiment of the invention, a cast composite material comprises a mixture of from about 5 to about 35 volume percent of silicon carbide particles and from about 95 to about 65 volume percent of a cast matrix alloy, the matrix alloy being an aluminum-based alloy containing from about 9.5 to about 11.0 weight percent silicon. Most preferably, the silicon content is about 10 percent by weight of the matrix.

In accordance with a processing aspect of the invention, a method for preparing a cast composite material comprises the steps of preparing a molten mixture of from about 5 to about 35 volume percent of free-flowing nonmetallic reinforcing particles and from about 95 to about 65 volume percent of a matrix alloy, the matrix alloy being an aluminum-based alloy containing from about 8.5 to about 12.6 weight percent silicon; mixing the molten mixture to wet the matrix alloy to the particles and to distribute the particles throughout the volume of the melt, the mixing to occur while minimizing the introduction of gas into and retention of gas within the molten mixture; casting the molten mixture; remelting the cast mixture at a temperature that reaches at least about 1300° F.; and recasting the remelted mixture.

The particles are preferably silicon carbide, because of their light weight and inexpensive commercial availability in suitable forms and sizes. Other nonmetallic reinforcing particles such as other carbides, oxides, nitrides, silicides, and borides, may also be used. The particles must be "free-flowing" in the sense that they are not constrained against movement to reach a uniform distribution throughout the composite material, and are not attached or constrained by a substrate or each other, as is the case for elongated fibers.

The particles constitute from about 5 to about 35 volume percent of the composite material. If less than about 5 volume percent is present, the composite material does not achieve properties superior to those of the conventional, non-composite material. Potentially incurring the problems of a composite material is therefore not justified by superior properties. If more than about 35 volume percent is present, the composite material is so viscous that it cannot be cast. This upper limit to the amount of particulate material can vary somewhat with the shape and type of the particulate material.

The remainder of the composite material, from about 95 to about 65 percent by volume, is the matrix alloy. The matrix alloy is an aluminum-based alloy containing from about 8.5 to about 12.6 weight percent silicon, balance aluminum and other alloying ingredients selected to impart particular mechanical and physical properties to the final solid composite material. Preferably, the silicon content of the matrix is from about 9.5 to about 11.0 weight percent.

The high silicon level has several important functions. The silicon influences the formation of the intermetallic compound aluminum carbide, $Al_4C_3$, and in particular suppresses its formation. When molten aluminum is contacted to a carbide such as silicon carbide, the formation of aluminum carbide is thermodynamically favored by a negative free energy of formation. The aluminum carbide is hygroscopic and will absorb moisture. The result is porosity in the final cast product.

The kinetics of aluminum carbide formation have been discovered to be such that melting and mixing of a cast composite material having a conventional aluminum-7 (or less) weight percent silicon alloy matrix at a controlled temperature of, for example, about 1325° F. for a relatively short period of time of about one hour, permits only a small and acceptable amount of the aluminum carbide to form. Thus, an acceptable cast composite material can be prepared by a carefully controlled melting and mixing procedure.

If, however, the cast composite material having such a conventional matrix alloy is thereafter remelted in a foundry practice of 1450° F. for 24 hours, the aluminum carbide formation continues at an accelerated rate. Aluminum carbide intermetallic compound grows from silicon carbide particles as outwardly projecting needles, which can break off to form particles in the melt.

One potential solution would be to place tight operational controls on foundries. Such controls would not be accepted by some foundries, and in all cases would inhibit the introduction and use of the cast composite materials in applications where they would otherwise be useful.

It has now been discovered that carefully selected larger amounts of silicon in the matrix alloy suppress aluminum carbide formation even during extended holding periods at very high temperatures sufficiently to permit casting of the composite material. The remelted composite materials having the higher silicon content within particular ranges simultaneously achieve exceptional castability and fluidity, without occurrence of primary phases such as pure silicon. Amounts of silicon greater than about 8.5 percent result in significantly reduced aluminum carbide formation and improved remelt fluidity, and amounts of silicon greater than about 9.5 percent eliminate aluminum carbide formation entirely and result in the greatest remelt fluidity for the selected particulate content and remelt temperature and holding conditions.

Castability and fluidity of remelt alloys are of direct interest to foundrymen, because improvements in these characteristics have direct consequences in the ability to cast intricate parts in a reproducible manner. The composite materials of the invention have been comparatively tested to measure their fluidity under typical foundry remelt conditions. FIG. 1 illustrates a device 10 for measuring fluidity. Molten composite material 12 is held in a heated crucible 14, with the temperature measured by a thermocouple 16. One end of a hollow pyrex glass tube 18, here about 5 millimeters inside diameter, is inserted vertically into the melt 12. A vacuum of about 25 inches of mercury is applied to the other end of the tube 18 by a vacuum pump 20. Molten composite material is drawn up the inside of the tube 18 until the metallic portion of the composite material freezes. The tube 18 is removed from the melt, and the distance of travel of the composite material up the tube prior to freezing is measured.

A number of specimens of composite material were evaluated using the apparatus of FIG. 1. Two kilogram heats were prepared with 20 volume percent silicon carbide particles in an aluminum-alloy matrix containing varying amounts of silicon as an alloying ingredient. Melts were prepared with matrix silicon contents of 7, 8, 9, 10, 11, 12, and 13 weight percent silicon. The melts were prepared in a mixer like that disclosed in U.S. Pat. Nos. 4,759,995 and 4,786,467, whose disclosures are incorporated by reference. The melts were cast into molds and solidified. The castings were remelted in crucibles under air at a temperature of 1450° F. and held for 24 hours. The temperature of the melt was reduced to 1275° F. ±10° F., and tested for fluidity using the apparatus of FIG. 1.

Figure 2:
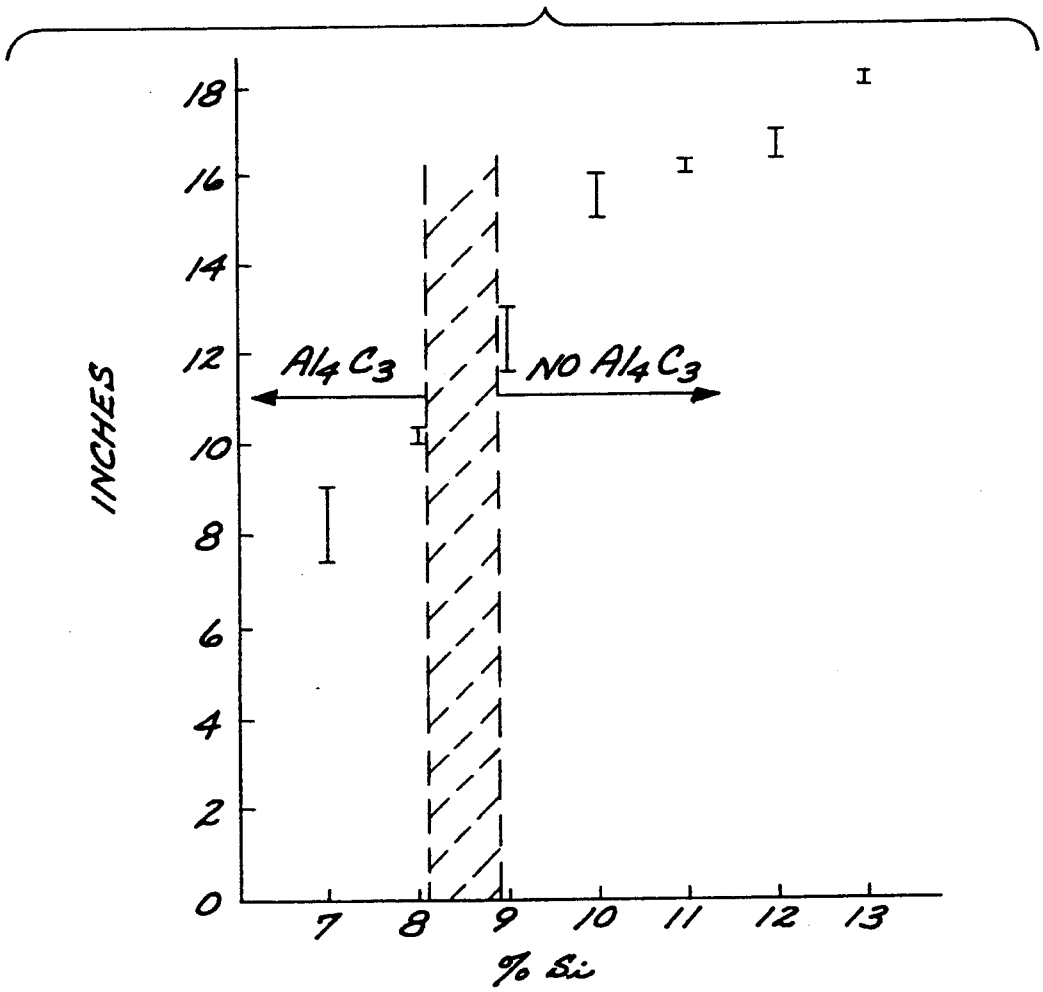
FIG. 2 is a graph of fluidity test results as a function of silicon content.

FIG. 2 presents the height rise for the composite materials in inches above the melt level. The greater the height rise, the greater the fluidity. The fluidity increases from a low value at 7 weight percent silicon, to a level at 10 weight percent silicon that remains nearly constant with further increases in silicon content to 13 weight percent. Specimens were cut from the tubes and examined metallographically. The amount of aluminum carbide in the 7 weight percent silicon material was large. A much smaller amount was visible in the sample containing 8 weight percent silicon. There was no aluminum carbide visible in the alloys containing 9 weight percent or more of silicon.

From these data, it was concluded that the minimum silicon content for suppression of aluminum carbide formation, in conditions of extended exposure, together with attainment of acceptable fluidity was about 8.5 percent. This value is marginal, as the aluminum carbide is nearly completely absent, but the fluidity has not reached its greatest value. A preferred minimum silicon content was therefore selected to be about 9.5 weight percent, a level at which no aluminum carbide is present and the fluidity has nearly reached its highest level.

Although the fluidity appears to increase with ever-increasing silicon content within this general range, there is a maximum limit to the silicon content of the matrix alloy. The maximum silicon content of the matrix alloy according to the present invention is about 12.6 weight percent. This is the value of the aluminum-silicon eutectic composition. For greater amounts of silicon, there are two undesirable results. First, the liquidus temperature rises so that the superheat for a selected remelt temperature is reduced. Second, primary silicon particles are precipitated in the matrix upon solidification. The silicon particles reduce the ductility of the matrix. A preferred maximum silicon content is slightly lower, at 11.0 percent. Metallographic studies reveal that, in the range 11.0–12.6 weight percent silicon, there can be some precipitation of primary silicon in the final structure, regardless of the expected equilibrium phase diagram. Also, there is observed some shrinkage of the matrix alloy during solidification.

The minimum silicon content of the matrix of the present composite material is therefore about 8.5 weight percent, and the preferred minimum is about 9.5 weight percent. The maximum silicon content of the matrix of the present composite material is about 12.6 percent, and the preferred maximum is about 11.0 percent. These values are selected because of, and in conjunction with, the presence of the free-flowing reinforcement particles in the composite material and the potential for chemical interaction between the matrix alloy and the particles as has been discussed herein. The choice of silicon content in non-composite alloys, and alloys that are not to be cast, is therefore not pertinent to the selection of silicon levels for the matrices of cast composite materials.

Most preferably, the silicon content is about 10 weight percent of the matrix, to provide a margin of error between the preferred limits of 9.5 and 11.0 weight percent, and to achieve close to the maximum fluidity possible in this general range.

The silicon in the matrix appears to suppress the formation of aluminum carbide by altering the thermodynamic equilibria of the system. To a good approximation, these equilibria are not affected by the presence of metallic alloying elements commonly provided in aluminum alloys to achieve specific properties such as strength, toughness, corrosion resistance, and the like in the final cast product. Thus, superior casting performance can be achieved by maintaining the proper silicon content, and other alloying elements can be added to achieve specific properties in the final product. Such alloying elements include, for example, copper, nickel, magnesium, iron, and manganese.

The following examples are presented in addition to those discussed previously to illustrate aspects of the invention, but are not intended to limit the invention in any respect.

EXAMPLE 1

Figure 3:
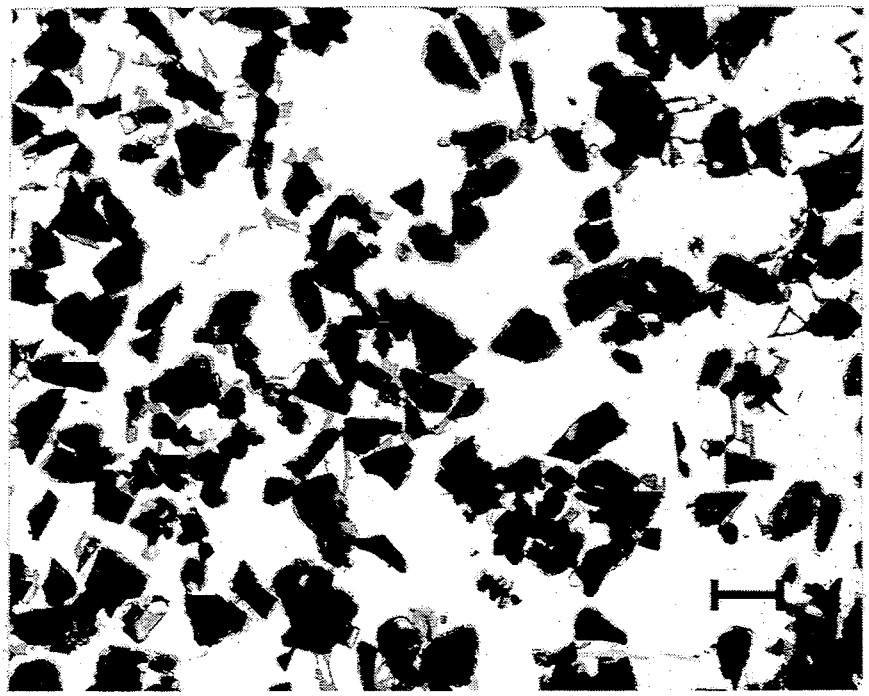
FIG. 3 is a micrograph of a cast composite material having an aluminum-based matrix containing 7 weight percent silicon.

A cast composite material was prepared from 20 volume percent silicon carbide particles and 80 volume percent of an alloy meeting a specification of 7 weight percent silicon, 0.3–0.45 weight percent magnesium, balance aluminum. This matrix alloy is not within the scope of the invention, and is presented for comparative purposes. The cast composite material was prepared by the procedures discussed previously. The cast composite material was remelted at a temperature of over 1400° F. A sample was taken of the remelted composite material, and its microstructure is illustrated in FIG. 3. Aluminum carbide intermetallic compound is found extensively throughout the microstructure as a dark-appearing phase. In FIG. 3, circles have been drawn around some of the aluminum carbide particles and regions for illustrative purposes.

EXAMPLE 2

Figure 4:
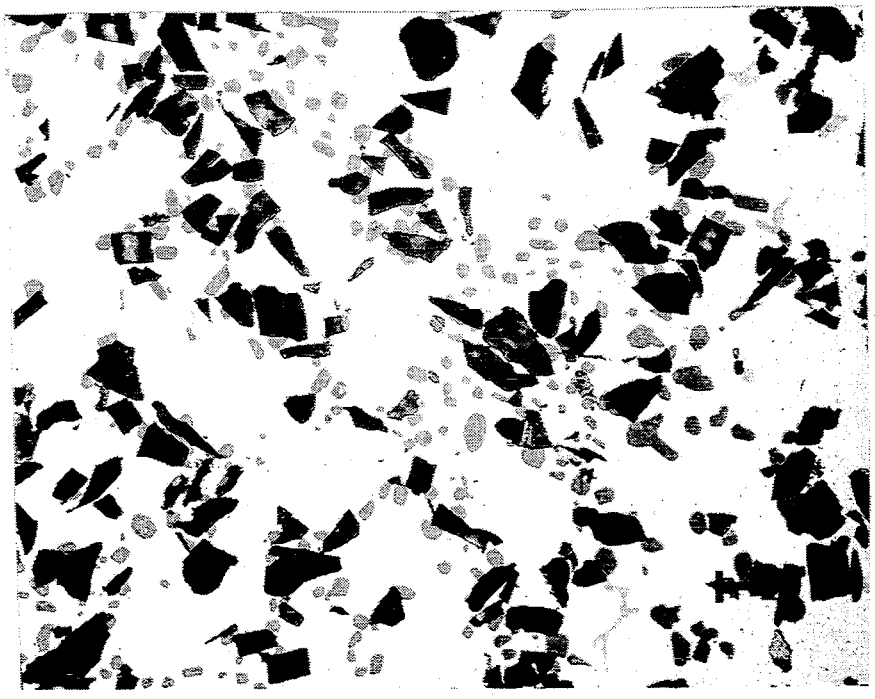
FIG. 4 is a micrograph of a cast composite material having an aluminum-based matrix containing 10 weight percent silicon.

Example 1 was repeated, except using a matrix alloy that meets a specification of 10 weight percent silicon, 0.8–1.0 weight percent magnesium, balance aluminum. Except for the higher silicon content within the preferred range of the invention and a minor difference in magnesium content, this matrix alloy has the same composition as that of Example 1. The microstructure of this alloy is shown in FIG. 4. There is no aluminum carbide visible in the microstructure.

EXAMPLE 3

Figure 5:
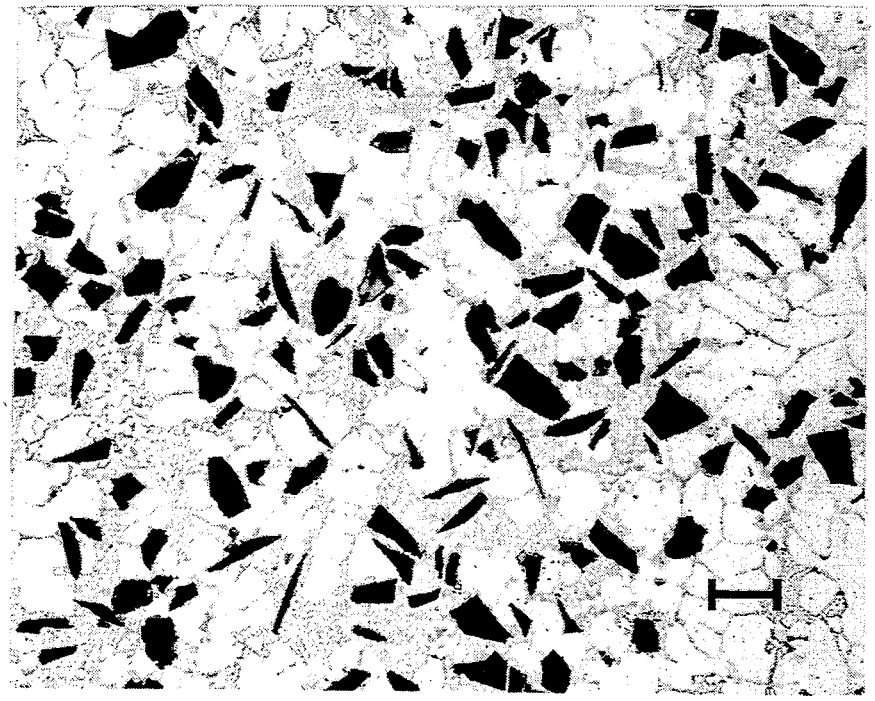
FIG. 5 is a micrograph of a cast composite material having an aluminum-based matrix containing 10 weight percent silicon and additional alloying elements.
Figure 6:
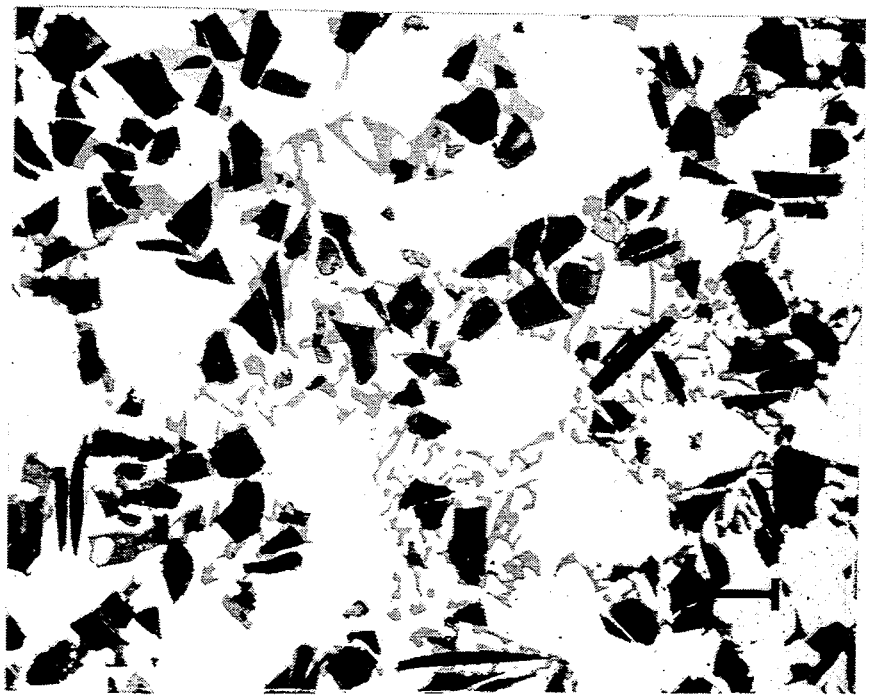
FIG. 6 is a micrograph of another cast composite material having an aluminum-based matrix containing 10 weight percent silicon and additional alloying elements.

Example 1 was repeated, except using a matrix alloy that meets a specification of 10 weight percent silicon, 0.5–1.0 weight percent iron, 3.0–3.5 weight percent copper, 0.2–0.6 weight percent manganese, 0.3–0.5 weight percent magnesium, 1.0–1.5 weight percent nickel, balance aluminum. This matrix alloy is within the scope of the invention, having 10 weight percent silicon. It is a more complex alloy in that it also contains iron, copper, manganese, and nickel. This cast composite material is suitable as a die casting alloy. FIG. 5 illustrates the microstructure of this cast and then remelted alloy. There is no aluminum carbide visible in the microstructure.

EXAMPLE 4

Example 1 was repeated, except using a matrix alloy that meets a specification of 10 weight percent silicon, 2.8–8.2 weight percent copper, 0.8–1.2 weight percent magnesium, 1.0–1.5 weight percent nickel, balance aluminum. This matrix alloy contains copper and nickel in addition to the silicon within the range of the invention and magnesium. This composite material is suitable as a high temperature sand and permanent mold casting alloy. FIG. 5 illustrates the microstructure of this cast and remelted alloy. There is no aluminum carbide visible in the microstructure.

Example 2 demonstrates that the addition of silicon to within the range of the invention suppresses aluminum carbide formation, as compared with the alloy of Example 1. Examples 3 and 4 demonstrate that additions of other alloying elements do not interfere with the suppression of aluminum carbide formation by the high silicon content. The results of FIG. 2 demonstrate that the 10 weight percent silicon alloy has excellent fluidity, and it was observed to have good castability.

The composite material of the invention provides an important commercial advance in the art of cast composite materials. The material can be mixed and cast by a primary composite material supplier, and shipped as a cast ingot to a foundry for remelting and casting into precise shapes as required. The composition of the matrix alloy is selected so that the remelting practice at the foundry may be similar to conventional remelt practices, which would not be possible for a cast composite material of conventional alloying content. Excellent fluidity is retained by the molten composite material even when it is held in a remelt crucible for extended periods of time and at temperatures previously thought to be unacceptably high because they produce undesirable reaction products.

Although particular embodiments of the invention have been described in detail for purposes of illustration, various modifications may be made without departing from the spirit and scope of the invention. Accordingly, the invention is not to be limited except as by the appended claims.

What is claimed is:

1. A method for preparing a cast composite material, comprising the steps of:

furnishing an aluminum-based matrix alloy containing from about 8.5 to about 11.0 weight percent silicon;

preparing a mixture of from about 5 to about 35 volume percent of free-flowing nonmetallic reinforcing particles and from about 95 to about 65 volume percent of molten matrix alloy; and preparing a cast composite material by using the mixture of particles and matrix alloy in a process having the steps of mixing the mixture to wet the molten matrix alloy to the particles and to distribute the particles throughout the volume of the melt, the mixing to occur while minimizing the introduction of gas into and retention of gas within the molten mixture, and casting the molten mixture.

2. The method of claim 1, wherein the particles are carbides.

3. The method of claim 1, wherein the aluminum alloy contains from about 9.5 to about 11.0 weight percent silicon.

4. The method of claim 1, wherein the matrix alloy further contains at least one additional alloying element selected from the group consisting of copper, nickel, magnesium, iron, and manganese.

5. A method for preparing a cast composite material, comprising the steps of:

furnishing an aluminum-based matrix alloy containing from about 8.5 to about 11.0 weight percent silicon;

preparing a mixture of from about 5 to about 35 volume percent of free-flowing silicon carbide particles and from about 95 to about 65 volume percent of molten matrix alloy; and preparing a cast composite material by using the mixture of silicon carbide particles and matrix alloy in a process having the steps of mixing the mixture to wet the molten matrix alloy to the silicon carbide particles and to distribute the silicon carbide particles throughout the volume of the melt, the mixing to occur while minimizing the introduction of gas into and retention of gas within the molten mixture, and casting the molten mixture.

6. The method of claim 5, wherein the aluminum alloy contains from about 9.5 to about 11.0 weight percent silicon.

7. The method of claim 5, wherein the matrix alloy further contains at least one additional alloying element selected from the group consisting of copper, nickel, magnesium, iron, and manganese.

8. A method for preparing a cast composite material, comprising the steps of:

furnishing an aluminum-based matrix alloy containing from about 8.5 to about 11.0 weight percent silicon;

preparing a mixture of from about 5 to about 35 volume percent of free-flowing nonmetallic reinforcing particles and from about 95 to about 65 volume percent of molten matrix alloy; and preparing a cast composite material by using the mixture of particles and matrix alloy in a process having the steps of mixing the mixture to wet the molten matrix alloy to the particles and to distribute the particles throughout the volume of the melt, and casting the molten mixture.

9. The method of claim 8, wherein the particles are carbides.

10. The method of claim 8, wherein the particles are silicon carbide.

11. The method of claim 8, wherein the aluminum alloy contains from about 9.5 to about 11.0 weight percent silicon.

12. The method of claim 8, wherein the matrix alloy further contains at least one additional alloying element selected from the group consisting of copper, nickel, magnesium, iron, and manganese.

* * * * *